US005163647A

United States Patent [19]

Fader et al.

[11] Patent Number: 5,163,647

[45] Date of Patent: Nov. 17, 1992

[54] UNIVERSAL FULCRUM

[76] Inventors: Merkel Fader, 910 Sue Dr., Caro, Mich. 48723; John C. Richardson, 4904 Mertz Rd., Mayville, Mich. 48744

[21] Appl. No.: 659,713

[22] Filed: Feb. 25, 1991

[51] Int. Cl.[5] ..... F16L 3/00

[52] U.S. Cl. ..... 248/123.1; 446/34

[58] Field of Search ..... 248/176, 121, 122, 123.1, 248/178, 179, 181, 182, 180, 374, 280.1, 325; 446/34; 244/190

[56] References Cited

U.S. PATENT DOCUMENTS

| | | | |
|---|---|---|---|
| 2,479,720 | 8/1949 | Brandt | 248/123.1 |
| 2,539,357 | 1/1951 | Wald | 446/34 X |
| 2,614,363 | 10/1952 | Bowditch | 248/464 X |
| 2,910,260 | 10/1959 | Tanner | 248/181 |
| 3,204,952 | 9/1965 | Mitchell | 446/34 X |
| 3,467,350 | 9/1969 | Tyler | 248/364 X |
| 3,756,549 | 9/1973 | Lange | 248/123.1 |
| 4,402,646 | 9/1983 | Rouzo | 248/123.1 X |
| 4,702,450 | 10/1987 | Barisa | 248/123.1 |
| 4,741,607 | 5/1988 | Heller | 248/280.1 X |

*Primary Examiner*—J. Franklin Foss
*Attorney, Agent, or Firm*—John J. Swartz

[57] ABSTRACT

Apparatus for mounting an object, such as a model airplane, on a support surface such as an upstanding rod. The apparatus includes an elongate rod mounted on an intermediate portion of the model for longitudinal movement to any selected one of a plurality of different positions to adjust the center of gravity and the attitude of the model relative to the support surface.

34 Claims, 3 Drawing Sheets

UNIVERSAL FULCRUM

BACKGROUND OF THE INVENTION

1. Field of the Invention

This invention relates to apparatus for supporting an object on a surface and more particularly to new and novel apparatus for supporting an object, such as a toy airplane, for universal movement on a support surface.

2. Description of the Prior Art and Objects

Novelty items, models, dolls and toys, such as toy airplanes are frequently mounted on a support surface via a pedestal which requires a relatively large underlying support surface. Such support surfaces might typically comprise a shelf, table or platform as is entirely conventional. Such mounting pedestals limit the display area and sometimes interfere with the aesthetics of such displays. Accordingly, it is an object of the present invention to provide a new and novel apparatus for mounting an object, such as a toy airplane or a model bird or butterfly, on an underlying support surface.

It is another object of the present invention to provide apparatus for supporting an object for universal movement on an underlying support surface.

It is yet another object of the present invention to provide new and novel apparatus for improving the aesthetics of displays of objects such as toy airplanes.

It is a further object of the present invention to provide apparatus for mounting objects such as a toy airplane on a support surface with substantially point contact.

It is a still further object of the present invention to provide new and novel apparatus for mounting an object such as a toy airplane on a substantially smaller area than that which has been required heretofore.

Still another object of the present invention is to provide new and novel mounting apparatus of the type described which can substantially mount the object on any surface.

It has been found that objects, such as toy airplanes, can be more effectively displayed if they are not all uniformly mounted but rather are angled relative to each other and the support surface. Accordingly, it is an object of the present invention to provide mounting apparatus of the type described which can be easily adjusted to display the object in any selected one of a plurality of different attitudes relative to the support surface on which it is mounted.

Another object of the present invention is to provide mounting apparatus of the type described which comprises an elongate rod mounted on an intermediate portion of an object to be mounted.

A further object of the present invention is to provide mounting apparatus of the type described including apparatus for longitudinally adjusting the mounting rod to any selected one of a plurality of different longitudinally spaced positions to adjust the attitude of the object relative to the support surface on which the object is mounted.

A still further object of the present invention is to provide apparatus of the type described wherein the elongate rod is non-linear.

Yet another object of the present invention to provide a mounting apparatus of the type described including mechanism for adjusting the center of gravity of the object relative to an underlying support surface.

Another object of the present invention is to provide mounting apparatus of the type described which can be adjusted to adjust the attitude of the object relative to the surface on which it is mounted.

It has been found that the object to be mounted can comprise a mounting platform on which another object, such as a toy doll can be mounted. To increase the versatility of the device and allow various objects of different weights and sizes to be mounted thereon, the mounting platform mounts a pair of laterally and vertically adjustable rods adjustably mounting weights to counterbalance the weight of the object set on the platform. Accordingly, it is another object of the present invention to provide apparatus of the type described wherein the object to be mounted is a mounting platform and mounts a pair of laterally, longitudinally, and vertically adjustable counterbalances mounted thereon.

Other objects and advantages of the present invention will become apparent to those of ordinary skill in the art as the description thereof proceeds.

SUMMARY OF THE INVENTION

Apparatus for supporting an object, such as a toy airplane, on a surface comprising an elongate support rod having a first mounting end and a second support end comprising a fulcrum for supporting the object for universal movement on a surface; mechanism adjustably mounts the rod on the object in any one of a plurality of different longitudinally adjusted positions relative to the object to change the center of gravity and the attitude of the object relative to the surface. In one aspect of the invention, the object comprises a platform for supporting another object, such as a doll and adjustable counterbalances are mounted on the platform to adjust the attitude of the object relative to the surface on which it is mounted.

DESCRIPTION OF THE DRAWINGS

The invention may be more readily understood by referring to the accompanying drawings, in which.

DESCRIPTION OF THE PREFERRED EMBODIMENT

Figure 1:
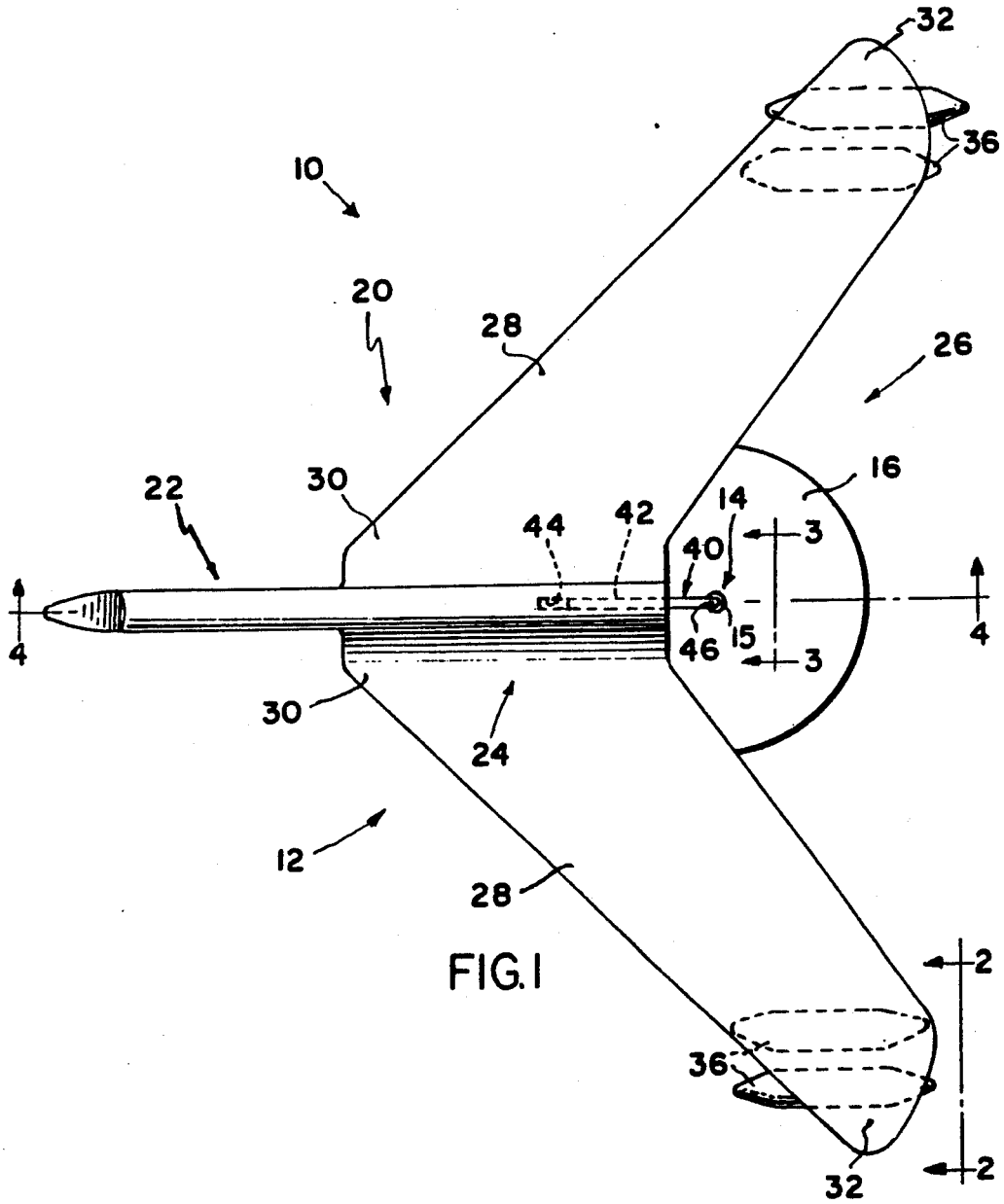
FIG. 1 is a top plan view of universal fulcrum apparatus, constructed according to the present invention, mounting a toy airplane.
Figure 2:
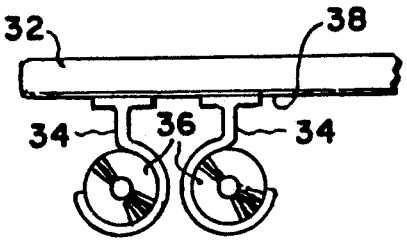
FIG. 2 is an enlarged, fragmentary rear elevational view, taken along the line 2—2 of FIG. 1.

Apparatus constructed according to the present invention, generally designated 10, is particularly adapted for use in mounting an inanimate object, such as a model airplane, generally designated 12, on an upstanding pedestal, generally designated 14.

The pedestal 14 includes a base, generally designated 16, mounting a vertical support rod 18 having a terminal top 15.

The model airplane 12 includes a fuselage or body, generally designated 20, having a forward end portion or nose, generally designated 22, an intermediate portion, generally designated 24, and a rear end portion or tail, generally designated 26. The rear end portion 26 includes a pair of rearwardly outwardly diverging wing sections 28 having forward ends 30 coupled to the intermediate section 24 and rear wing tip ends 32 which are laterally outward and rearward of the intermediate portion 24. Fixed to the underside of the rearward wing portions 32 are mounts 34 which cradle a pair of toy bombs 36 which are disposed below the underside 38 of the intermediate body section 24 to counterbalance the weight of the nose 22.

Figure 3:
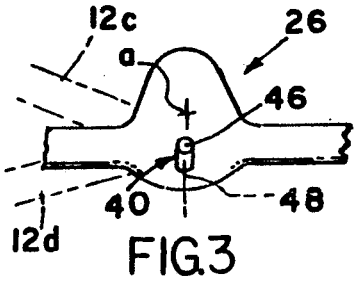
FIG. 3 is a fragmentary rear elevational view, taken along the line 3—3 of FIG. 1.
Figure 4:
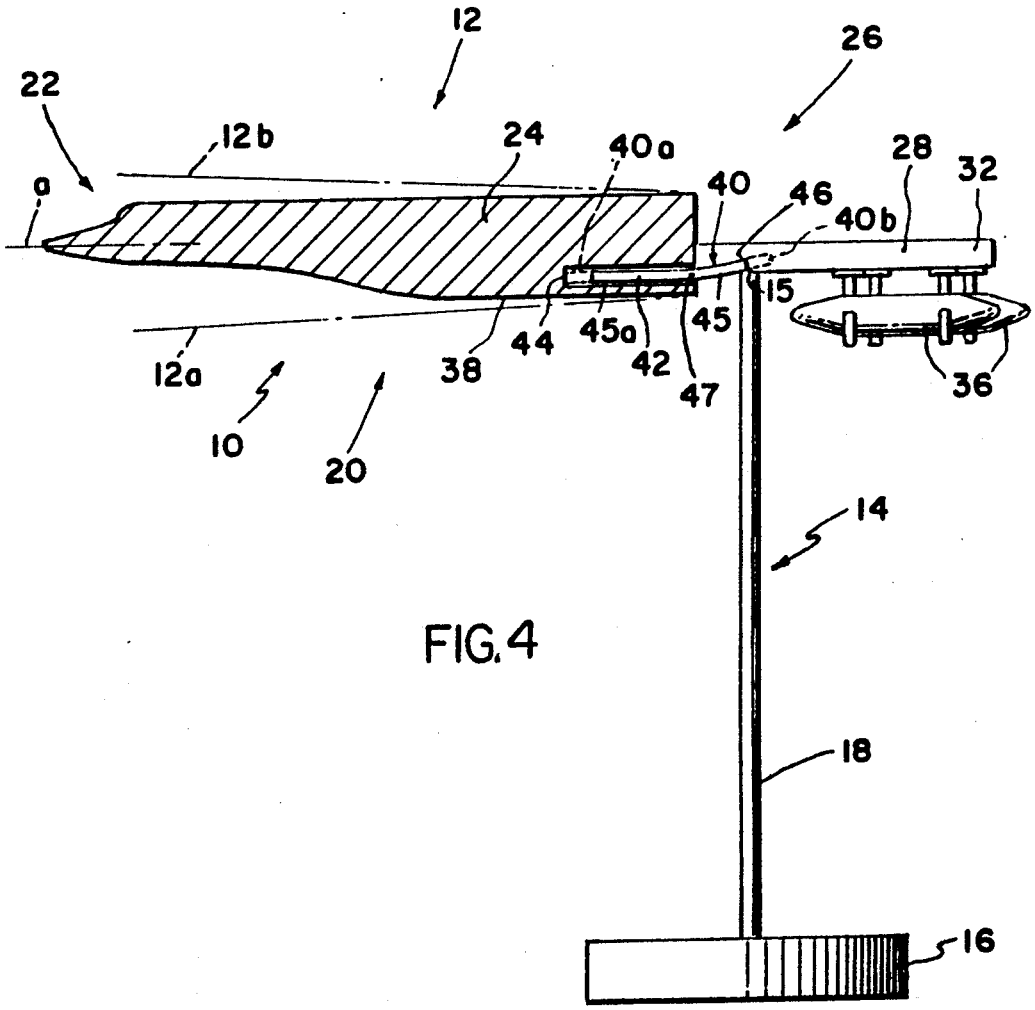
FIG. 4 is a sectional side view, taken along the line 4—4 of FIG. 1.

The universal fulcrum mount apparatus 10 includes an elongate rod 40 having a straight or linear forward end portion 42 and an offset, linear rear end portion 45 coupled to the forward end portion 42 via a curved elbow 47. The forward end portion 42 is frictionally slidably received within a cylindrical recess 44 provided in the intermediate body portion 24 of the model 12. The rod 40 is cantileverly mounted and includes a rear terminal end 46 which is received on the top surface 15 of the rod 14 with substantial point contact. The forward rod end portion 42 is firmly, frictionally secured to the cylindrical wall 45*a* of the cylindrical recess 44 to preclude relative rotational or longitudinal movement therebetween when the model 12 is at rest as illustrated in FIG. 4. Nonetheless, the position of the rod 40 may be rotationally and longitudinally adjusted relative to the longitudinal axis 48 of the rod end portion 42 and relative to the cylindrical wall 45 to adjust the roll or pitch of the model 12, relative to its longitudinal axi a and the surface 15, to the positions illustrated in chain lines at 12*c* or 12*d* in FIG. 3.

The rod 40 may be longitudinally forwadly or rearwardly moved within the aperture 44 from the intermediate position, illustrated in solid lines in FIG. 4, to the forward or rearward positions, illustrated in chain lines at 40*a* and 40*b* respectively in FIG. 4, to change the center of gravity of the object 20 relative to the rod 14. Thus the attitude of the model airplane 20, relative to the support surface 15, likewisely changes from generally horizontal position, illustrated in solid lines in FIG. 4, to a forwardly, upwardly inclined position, illustrated at 20*b* in chain lines in FIG. 4, or a forwardly downwardly inclined position illustrated at 20*a* in FIG. 4. The terminal end 46 comprises a fulcrum which provides universal movement of the object 12 relative to the support end 15 for movement in any direction relative to the support surface 15.

Although the object 12 mounted by the universal fulcrum 10 is illustrated as being a model airplane, it should be understood that the object being mounted could comprise many different toys and models such as birds, insects, or household items.

THE OPERATION

The model 12, with the rod 40 in the forward position illustrated in solid lines in FIG. 4, is mounted on the upper end surface 15 of pedestal 14 or on any surface such as an individual's finger or the upper corner surface of a desk or table. The object 12 is not limited to being mounted on the pedestal 14 but can be moved to any selected one of a plurality of different positions on a plurality of different support surfaces found throughout a house.

The attitude of the model 12 relative to the underlying support surface can be changed by moving the rod 40 inwardly or outwardly to the forward and rearward positions illustrated in chain lines at 40*a* and 40*b*, respectively, to change the attitude of the model plane 12 upwardly or downwardly, respectively, to that illustrated in chain lines at 12*a* and 12*b*, respectively.

The rod 40 can be rotated about the longitudinal axis 48 of the forward rod section 42 relative to the intermediate body portion 24 so that the roll or pitch of the model 20 relative to its longitudinal axis a and the support rod surface 15 can be adjusted to the positions schematically designated 12*a* or 12*b*.

MODIFIED EMBODIMENT

Figure 6:
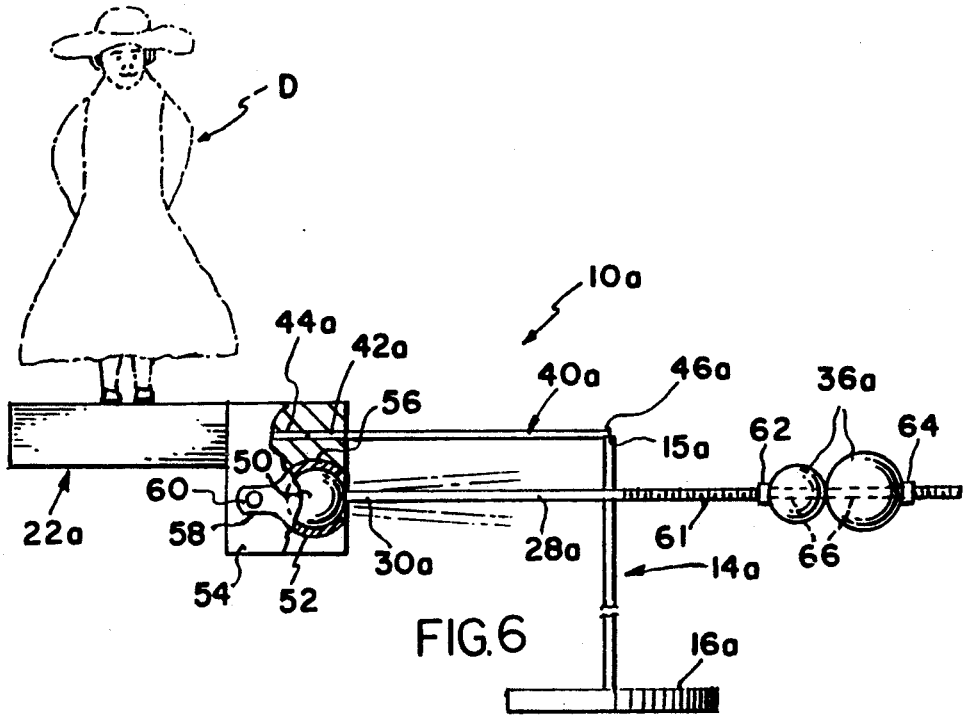
FIG. 6 is a side elevational view of the apparatus illustrated in FIG. 5 part of the mounting block and swivel mount being broken away in section to more clearly illustrate construction.
Figure 5:
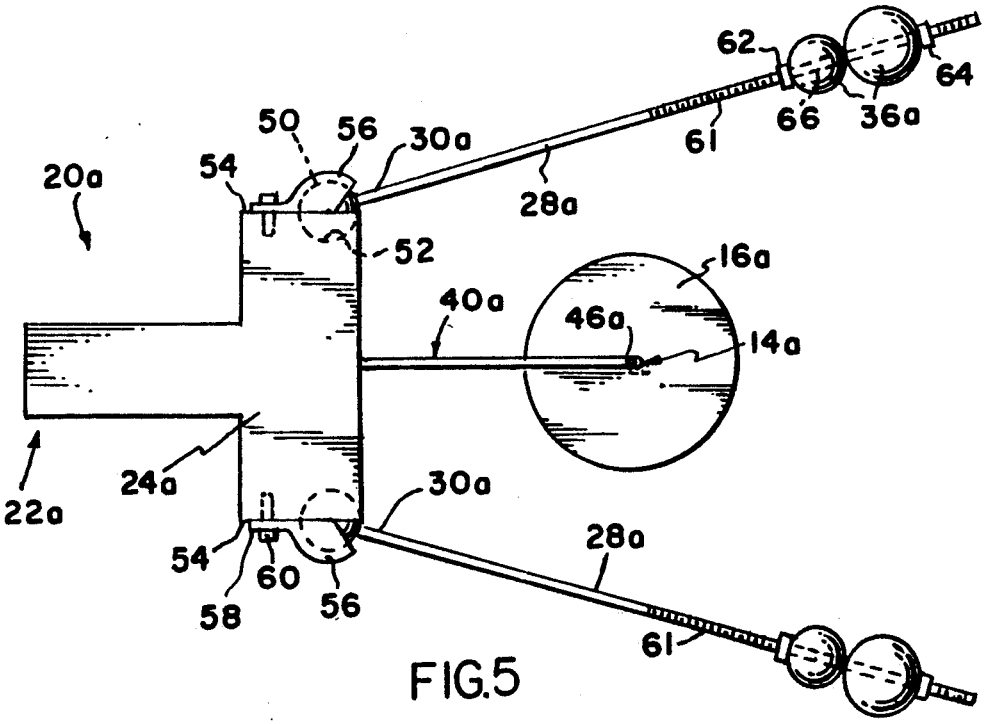
FIG. 5 is a top plan view of a modified construction.

Referring now more particularly to FIGS. 5 and 6, a slightly modified construction is illustrated wherein generally similar parts will be referred to by generally similar characters followed by the letter a.

As opposed to a model airplane 12, the object being mounted comprises a T-shaped block 20*a* having a forward end 22*a* and intermediate end 24*a* and the rear end portion 26*a* including a pair of rearwardly outwardly diverging elongate rods 28*a* having forward ends 30*a* mounted on a sphere 50 which is received in a semi-spherical pocket 52 provided at each end 54 of the intermediate body section 24*a*. The ball or sphere 50 is held detachably held in position via a semi-spherically shaped retainer clip 56 which has a tab 58 that is secured to the end 54 via a screw 60. When the screw 60 is released, the ball or sphere 50 can freely rotate to adjust the position of the rod 28*a* and when the clip 56 is clamped to the position illustrated in FIG. 5, the ball or sphere 50 and rods 28*a* will be fixed in position.

The rods 28*a* are threaded at 61 which threadably receive a pair of longitudinally spaced apart nut 62 and 64 between which is received a pair of counter balance weights 36*a* which have apertures 66 therethrough for slidably receiving the threaded rod section. The nut 62 and 64 can be longitudinally adjusted to position the counter balances 36*a* at any selected one of a plurality of different longitudinally spaced apart positions on the rods 28*a*.

A toy doll, generally designated D, may be mounted on the nose portion 22*a* for display purposes, if desired.

Depending on the weight and length of the nose 22*a* and the desired attitude as well as the weight of any object need to be mounted thereon, the counter balances 36*a* may be longitudinally positioned at any selected one of a plurality of different positions on the rods 28*a*.

Likewisely, by relatively spreading the rods 28 outwardly, the stability of the device against undesired roll can be increased. The swivel mounts 50, 52 in essence provide universal movement of the rods 28*a* in any desired direction downwardly or upwardly to control the pitch and roll of the device. One of the rods 28*a* can be moved upwardly or downwardly, or inwardly or outwardly relative to the other rod 28*a* to thus relatively move one of the counter balances upwardly or downwardly or inwardly or outwardly relative to the other counter balance 36*a*.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What we claim is:

1. Universal fulcrum apparatus for supporting an object, such as a toy airplane, on a surface comprising an elongate support rod having a first mounting end for mounting said object and a second support end;

said second support end comprising a fulcrum for supporting said rod and said object for universal movement on said surface; and means adjustably mounting said one mounting end of said rod on said object in any one of a plurality of different longitudinally adjusted positions relative to said object to change the center of gravity and the attitude of said object relative to said surface.

2. The apparatus set forth in claim 1 wherein said support rod is non-linear.

3. The apparatus set forth in claim 1 wherein said second end provides point contact with said surface.

4. The apparatus set forth in claim 1 wherein said object comprises a mounting platform on which another object, such as a doll, can be set; said apparatus further including counterbalance means for counterbalancing the weight of said another object.

5. The apparatus set forth in claim 4 wherein said counterbalance means comprises a pair of rearwardly outwardly diverging members mounted on said platform.

6. The apparatus set forth in claim 4 wherein said counterbalance means comprises a pair of rods having forward and rearward ends;

said rearward ends being laterally adjustable between spaced apart positions and less spaced apart, closed positions.

7. The apparatus set forth in claim 6 wherein said counterbalance means includes first and second counterweights adjustably mounted on said rearward ends of said rods for movement between any selected one of a plurality of rearward and forward positions.

8. The apparatus set forth in claim 7 wherein said rods each include a threaded portion and said counterbalance means includes means threadedly mounted on said rods for securing said counterweights in any selected one of said forward and rearward positions.

9. Apparatus for supporting an object on a surface wherein said object includes a forward portion, an intermediate portion and a rear terminal portion; said rear portion including rearwardly diverging, sections having forward ends coupled to said intermediate portion and rearward terminal ends disposed laterally outward and rearward of said intermediate portion; said apparatus comprising:

universal fulcrum means for supporting said object for universal movement on said surface; and means for mounting said universal fulcrum means on said intermediate portion between said rearwardly diverging sections forwardly of said rearward ends.

10. The apparatus set forth in claim 9 wherein said mounting means includes means for adjusting the position of said universal support means relative to said object to adjust the attitude of said object relative to said surface.

11. The apparatus set forth in claim 9 wherein said mounting means includes means for adjusting the center of gravity of said object relative to said surface.

12. The apparatus set forth in claim 9 wherein said universal support means comprises a rod having forward and rearward ends; said mounting means includes means for mounting said forward end of said rod on said intermediate portion in such position that said rearward end is cantileverly supported thereon to provide a fulcrum for pivotally mounting said object on said surface.

13. The apparatus set forth in claim 12 wherein said mount means includes means adjustably mounting said forward end of said rod on said intermediate portion for longitudinal movement to any selected one of a plurality of different longitudinal positions to change the center of gravity and the attitude of said object relative to said surface.

14. The apparatus set forth in claim 12 wherein said rod is non-linear.

15. The apparatus set forth in claim 9 wherein said object comprises a mounting platform on which another object, such as a doll, can be set; said apparatus further including counterbalance means for counterbalancing the weight of said another object.

16. The apparatus set forth in claim 15 wherein said counterbalance means comprises a pair of rearwardly outwardly diverging members mounted on said platform.

17. The apparatus set forth in claim 15 wherein said counterbalance means comprises a pair of rods having forward and rearward ends; said rearward ends being laterally adjustable between spaced apart positions and less spaced apart, closed positions.

18. The apparatus set forth in claim 17 wherein said counterbalance means includes first and second counterweights adjustably mounted on said rearward ends of said rods for movement between any selected one of a plurality of rearward and forward positions.

19. The apparatus set forth in claim 18 wherein said rods each include a threaded portion and said counterbalance means includes means threadedly mounted on said rods for securing said counterweights in any selected one of said forward and rearward positions.

20. Apparatus for supporting an object on a surface wherein said object includes forward, intermediate and rearward terminal portions; said rear portion including rearwardly diverging sections having forward ends mounted on said intermediate portions and rearward terminal ends disposed laterally outward and rearward of said intermediate portion; said apparatus comprising:

an elongate support rod having a forward mounting end and a rear support end comprising a fulcrum for supporting said rod and said object on said surface for movement in any direction relative to said surface; and means mounting said forward mounting end of said rod on said intermediate portion in such position that said rear support end is disposed between said rearwardly diverging sections rearward of said intermediate portion and forwardly of said rearward ends.

21. The apparatus set forth in claim 20 wherein said rear support end provides a point contact with said surface.

22. The apparatus set forth in claim 20 wherein said mounting means includes means adjustably mounting said rod for sliding movement to any selected one of a plurality of longitudinally different position relative to said intermediate portion to change the position of said object relative to said surface.

23. The apparatus set forth in claim 20 wherein said object comprises a mounting platform on which another object, such as a doll, can be set; said apparatus further including counterbalance means for counterbalancing the weight of said another object.

24. The apparatus set forth in claim 23 wherein said counterbalance means comprises a pair of rearwardly outwardly diverging members mounted on said platform.

25. The apparatus set forth in claim 23 wherein said counterbalance means comprises a pair of rods having forward and rearward ends;

said rearward ends being laterally adjustable between spaced apart positions and less spaced apart, closed positions.

26. The apparatus set forth in claim 23 wherein said counterbalance means includes first and second counterweights adjustably mounted on said rearward ends of said rods for movement between any selected one of a plurality of rearward and forward positions.

27. The apparatus set forth in claim 26 wherein said rods each include a threaded portion and said counterbalance means includes means threadedly mounted on said rods for securing said counterweights in any selected one of said forward and rearward positions.

28. The apparatus set forth in claim 25 wherein at least a portion of each of said rods is universal by moveable in any selected direction relative to the other of said rods to adjust the position of one of said counter balance means relative to the other counter balance means.

29. The apparatus set forth in claim 25 including means for mounting said rods on said object for independent universal movement in any selected direction relative to the other of said rods to adjust the position of one of said rods relative to the other of said rods.

30. In combination with a body including a forward portion, an intermediate portion and a rear terminal portion; said rear terminal portion including rearwardly diverging, sections having forward ends coupled to said intermediate portion and rearward terminal ends disposed laterally outward and rearward of said intermediate portion;

universal fulcrum means for supporting said object for universal movement on a surface; and means for mounting said fulcrum universal means on said intermediate portion between said rearwardly diverging sections forwardly of said rearward ends.

31. The combination set forth in claim 30 wherein said fulcrum means comprises an elongate rod having a first mounting end coupled to said intermediate portion and a second supporting end disposed forwardly of said rearward terminal ends of said rearwardly diverging sections.

32. The combination set forth in claim 31 wherein mounting means comprises an open ended opening, slidably snugly receiving said first end in any selected one of a plurality of different longitudinally and rotationally spaced positions.

33. The combination set forth in claim 32 wherein said second end engages said surface with point contact.

34. In combination with an object including forward, intermediate and rearward terminal portions; said rear terminal portion including rearwardly diverging sections having forward ends mounted on said intermediate portions and rearward terminal ends disposed laterally outward and rearward of said intermediate portion;

apparatus for supporting said object on a surface comprising:

an elongate support rod having a forward mounting end and a rear support end comprising a fulcrum for supporting said rod and said object on said surface for movement in any direction relative to said surface; and means mounting said forward mounting end of said rod on said intermediate portion in such position that said rear support end is disposed between said rearwardly diverging sections rearwardly of said intermediate portion and forwardly of said rearward ends.

* * * * *